United States Patent [19]

MacGraw, II

[11] 4,158,474

[45] Jun. 19, 1979

[54] LIGHT BULB AND SOCKET COMBINATION

[76] Inventor: Richard MacGraw, II, 600 W. 113th St., New York, N.Y. 10025

[21] Appl. No.: 811,437

[22] Filed: Jun. 29, 1977

[51] Int. Cl.[2] ..... H01R 17/06; H01R 17/22

[52] U.S. Cl. ..... 339/135; 339/176 L; 339/177 L; 339/188 R; 339/209

[58] Field of Search ..... 339/103 R, 103 C, 103 B, 339/105, 136 R, 136 S, 139 R, 139 C, 140 R, 140 C, 144 R, 145 R, 146, 176 L, 177 R, 177 E, 177 L, 178, 180, 181 R, 181 C, 182 L, 188 R, 188 C, 189 R, 189 L, 209, 218 L, 135

[56] References Cited

U.S. PATENT DOCUMENTS

| | | | |
|---|---|---|---|
| 441,059 | 11/1890 | Collier | 339/180 |
| 985,241 | 2/1911 | Andersen | 339/177 E |
| 1,134,954 | 4/1915 | Keough | 339/105 |
| 2,225,461 | 12/1940 | Reynolds | 339/177 L |
| 2,470,280 | 5/1949 | Ackerman | 339/188 R |
| 3,040,285 | 6/1962 | Stanley | 339/188 R |
| 3,182,185 | 5/1965 | Ahroni et al. | 339/176 L |

FOREIGN PATENT DOCUMENTS

| | | | |
|---|---|---|---|
| 8069 | 9/1933 | Australia | 339/103 R |
| 76938 | 11/1961 | France | 339/176 L |
| 21419 of | 1911 | United Kingdom | 339/103 B |

*Primary Examiner*—Neil Abrams

[57] ABSTRACT

A light bulb is provided that may be hung from a ceiling and which does need any type of light fixture thereabout. The light bulb itself acts as a fixture and is connected to a light socket having a top cover plate and a mounting piece mounting the top cover plate thereabove. In one embodiment of the invention, the mounting piece has a pair of diametrically opposed circumferential slots for receiving therein the prongs of the light bulb, the slots lying adjacent to a pair of metal terminals cast into the plastic of the mounting piece. A spring holding element holds the prongs in the slots. In the second embodiment, the mounting piece is threaded to receive a threaded portion of the light bulb and has a lower annular groove and central aperture for receiving therein a ring-shaped metal contact and a split prong contact of the light bulb. A plurality of metal strips partially positioned in the annular groove serve to hold the ring-shaped metal contact in place.

12 Claims, 12 Drawing Figures

LIGHT BULB AND SOCKET COMBINATION

BACKGROUND OF THE INVENTION

The present invention is directed to a light bulb and socket arrangement for use in decorative lighting, and particularly to a hanging light fixture. Numerous bulb and socket arrangements for hanging light fixtures are present in the prior art but all suffer from the disadvantages of being difficult to assemble, costly to produce, and comprised of many individual parts, such as clamps, locks, extra connections, and a glass or plastic fixture surrounding a conventional bulb.

It is the object of the present invention to provide a bulb and socket arrangement that avoids the costliness of production, the multifold use of many parts, and the use of a surrounding light fixture. To this end, the present invention provides a hanging light fixture that utilizes a novel bulb and socket design so that the bulb itself, which may be spherical, polyhedral, etc., avoids the need of a surrounding light fixture of glass, plastic, and the like and which incorporates therewith a novel socket arrangement which is contained within the bulb itself. The novel socket of the present invention is simply hung from a ceiling and connected to a source of power in the ceiling with the bulb mounted about the socket acting as the light fixture.

SUMMARY OF THE INVENTION

It is, therefore, the primary object of the present invention to provide a novel light socket and bulb arrangement without the need of a surrounding light fixture, which is inexpensive to produce, and which is comprised of only a few parts.

The light socket and bulb arrangement of the present invention is made up of a light socket that is received within a light bulb so that the arrangement may be hung from a ceiling.

In one embodiment of the invention, the light socket is made up of a top cover plate mounted on a mounting piece of cylindrical shape. Both pieces are made of plastic and securely held together by bolts. The mounting piece has a pair of slots formed on its lower circumference which comprise a vertical portion and a triangular portion. The slots receive therein the contact prongs of a light bulb, which prongs are held in the slots by a spring positioned in the mounting piece by a spring holding element which telescopingly mounts the spring thereabout. A plastic disc engages the lower end of the spring and contacts and urges downwardly the prongs into the slots. The spring, plastic disc, and spring holding element are positioned in an enlarged central opening formed in the mounting piece. The prongs are held in the slots in a yieldable relationship so that the light bulb may be removed from the light socket simply by rotating the bulb 90 degrees, so as to position the prongs only in the vertical slot portions of the slots. A spring clip mounted between the prongs of the light bulb thereby forces the prongs out of the slots to affect removal.

In the second embodiment of the invention, the mounting piece is provided with a bottom annular groove and a central bottom aperture which receive therein a ring-shaped metal contact and a split metal prong, respectively, of the light bulb. The contacts of the light bulb are held in place by a plurality of metal strips extending partially into the annular groove. One of the metal strips acts as one of the two terminals of the socket, while a second terminal is provided by a split mounted in the central aperture which extends therebeyond to form a flanged portion having a threaded hole and screw for securing a stripped end of an electrical cord.

In both embodiments, a separating plastic disc is provided below the top cover plate which separates a clamping means from the metal terminals and which also serves to guide the stripped ends. The electrical cord used with the light socket may be reinforced with woven steel in order to support light bulbs of great weight. The light bulb itself may be made of glass, plastic, and the like, and may have a spherical, polyhedral, or cylindrical shape.

BRIEF DESCRIPTION OF THE DRAWING

The invention will be more readily understood with reference to the following detailed description when taken in conjunction with the accompanying figures, wherein.

DESCRIPTION OF THE INVENTION

Figure 1:
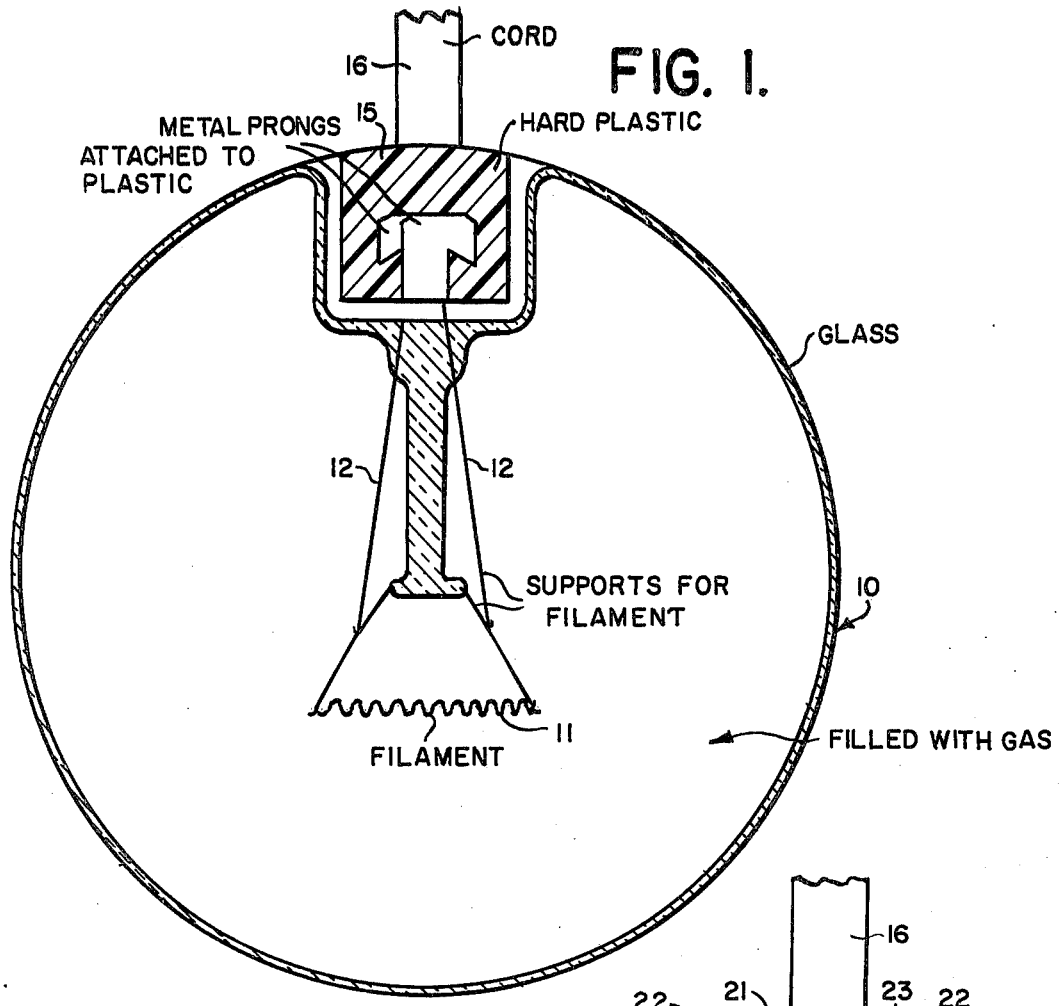
FIG. 1 is a general schematic view showing the light bulb and socket arrangement of the present invention.

FIG. 1 shows the general concept of the invention with a spherical light bulb 10 having therein a conventional filament 11 mounted within the bulb by supports 12. The interior of the bulb is filled with gas in the conventional manner. The bulb 10 may be made of plastic, glass, and the like and is mounted to a socket 15 in the manner to be described below. The socket 15 mounts the bulb 10 in such a way as to be positioned within the bulb as can be seen in FIG. 1, and is connected to a source of power via a cord 16. The manner of supplying current to the filament 11 as well as the mounting of the bulb 10 about the socket 15 will be described in greater detail below.

Referring now to FIGS. 2–6, the first embodiment of the present invention is shown for mounting the light bulb and for supplying current to the filament thereof. In this embodiment of the invention, the socket 15′ is comprised of a top removable cover plate 20, a metal hinged clamp 30, a separating plastic disc 40, a spring holding element 60, a spring 70, a plastic disc 80, and a cylindrically-shaped mounting piece 50.

Figure 12:
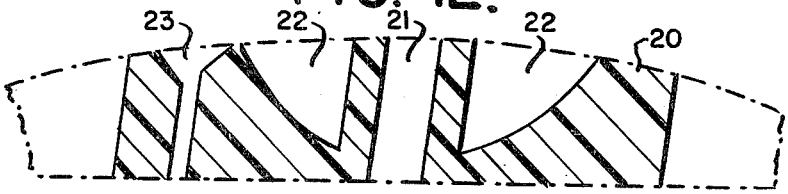
FIG. 12 is a cross-sectional view of the removable cover plate used in both embodiments of the invention.

The top removable cover plate 20 (see FIG. 12) is formed with a central opening 21 for the passage therethrough of the cord 16 and has positioned symmetrically about the central opening 21 a pair of finger depressions 22 for the holding of the top cover plate to allow for the light bulb 10′ to be mounted to the socket or to be removed therefrom, as is explained below. The top cover plate 20 is also provided with three symmetrically spaced holes for three mounting bolts 23 which mount the top cover plate 20 to the top of the cylindrically-shaped mounting piece 80. The top cover plate 20 is preferably made of a hard cast plastic and preferably has a slight curvature on the top part thereof that has a radius originating at the center of the spherical light bulb so that there is a continuity of surface shape between the transition from the light bulb to the socket.

The electrical cord 16 is held in place in the central opening 21 by the hinged clamp 30 which surrounds a portion of the cord 16 extending below the central opening 21. The hinged clamp 30 is of conventional design and therefore needs no further explanation.

Directly below the hinged clamp 30 is the plastic separating disc 40 which has two openings 31 and 32 which allow for the passage of the two stripped ends of the cord 16, and which serves to separate the metal hinged clamp 30 from the electrical terminals positioned therebelow.

Figure 2:
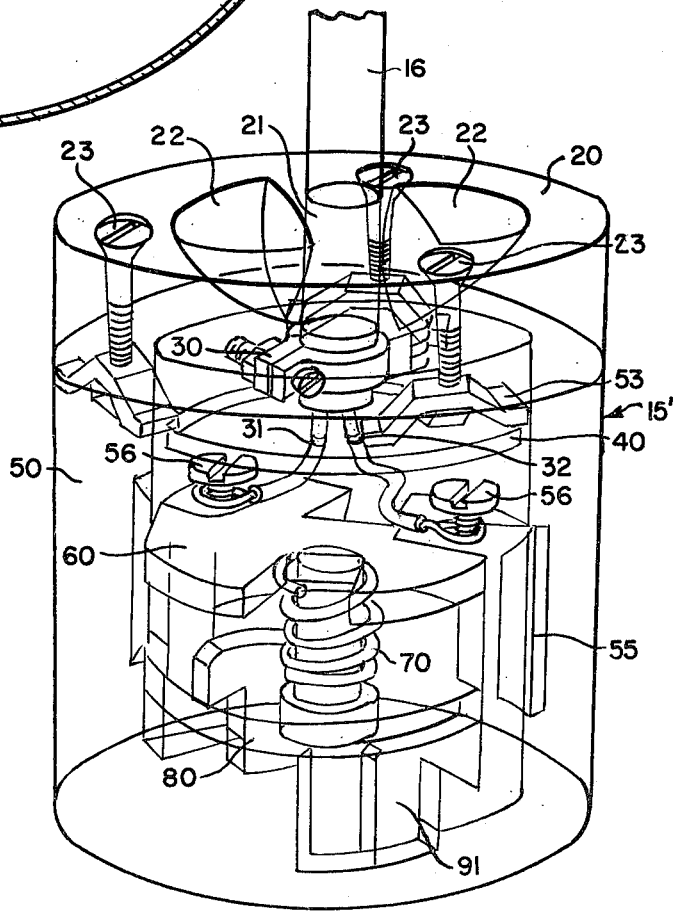
FIG. 2 is a perspective view showing the first embodiment of the light bulb and socket arrangement of the present invention.
Figure 5:
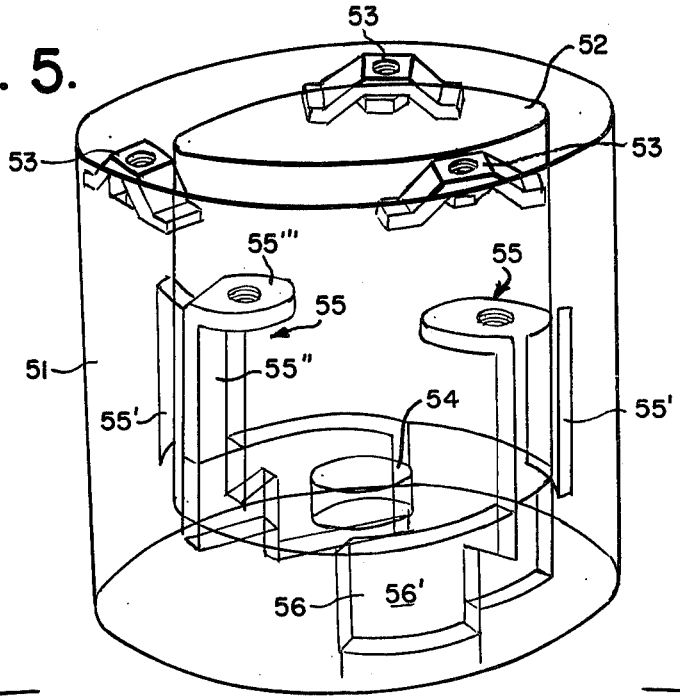
FIG. 5 is a perspective view showing the cylindrically shaped mounting piece which mounts the other parts of the socket arrangement and which receives therein the metal contact prongs of the light bulb.

The cylindrically-shaped mounting piece 50 is best shown in FIG. 5 and is comprised of an outer cylindrical wall 51 of hard cast plastic with an enlarged central opening 52 extending downwardly from the top surface of the piece to near the bottom. The top surface of the mounting piece 50 is provided with three metal nuts 53 cast into the plastic for receiving therein the bolts 23 of the top removable cover plate 20. The enlarged central opening 52 does not extend the full length of the mounting piece so that a smaller circular opening 54 may be provided in that lower portion of the mounting piece extending from the bottom surface. The opening 54 extends partially into the lower portion of the mounting piece to mount therein the elongated pin of the spring holding element to be described below. Positioned within the enlarged central opening 52 is a pair of diametrically opposed metal terminals 55 which are partially cast into the plastic of the mounting piece. The metal terminals 55 each have an embedded portion 55′, cast into the plastic, an elongated supporting portion 55″, and a threaded flange portion 55‴ which receives terminal post screws 56 which secure the stripped ends of the cord 16 to the terminals as can be seen in FIG. 2. Extending in the clockwise direction as seen in FIG. 5, and directly contiguous with the elongated portions 55′ are a pair of curved slots 56. Each curved slot has a rectangular vertical portion 56′ which extends from the bottom surface of the mounting piece, and a triangular portion 56″ which lies adjacent to the elongated support portion 55″ of the terminals. The slots 56 receive therein the metal prongs mounted in the initiator of the spherical light bulb so that the prongs contact the metal terminals 55 and complete the circuit to supply current to the filament of the bulb.

Figure 3:
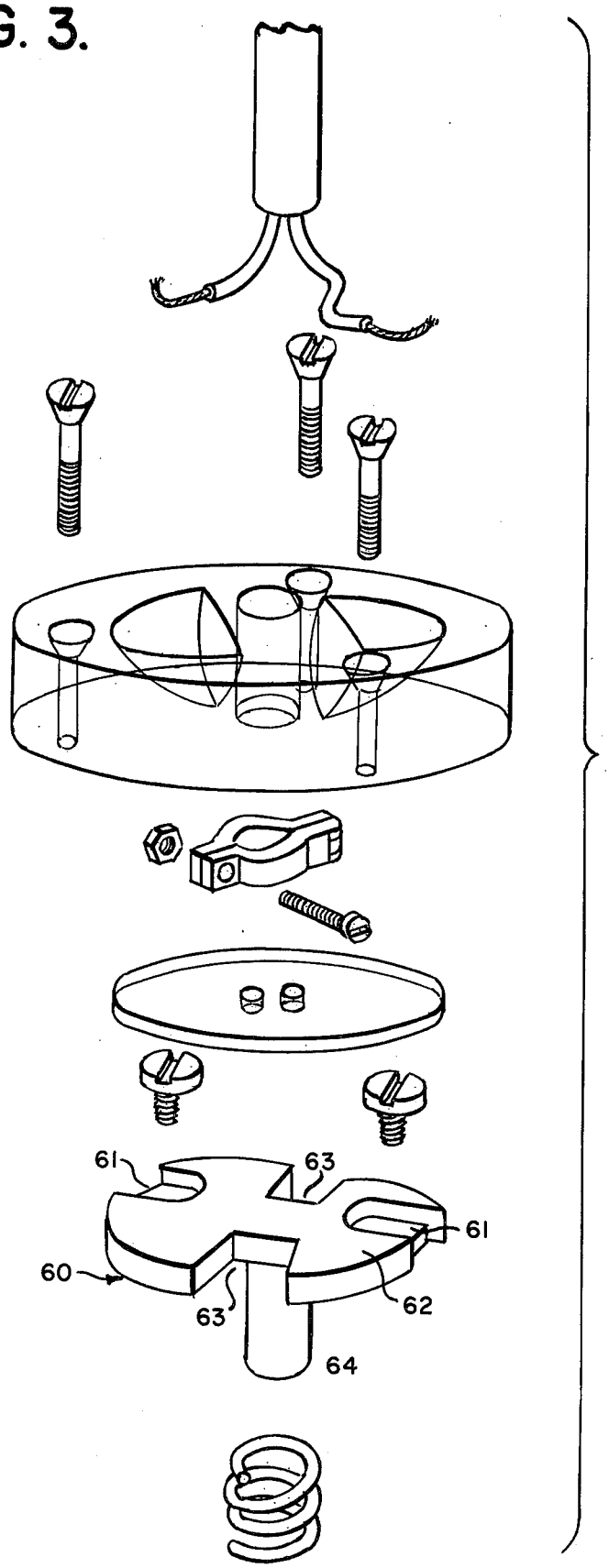
FIG. 3 is a perspective view showing the spring holding element for the socket arrangement of FIG. 2.
Figure 4:
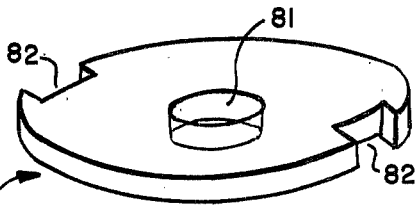
FIG. 4 is a perspective view showing the plastic disc of the present invention which is urged downwardly by a spring into contact with the metal contact prongs of the light bulb.

The spring holding element 60, which is shown in FIG. 2 and in detail in FIG. 3, serves to mount the spring 70 so that the plastic disc 80 clamps the metal prongs of the light bulb fast in the slots 56. The spring holding element 60, which is made of plastic, has a pair of diametrically opposed depressions formed in a top portion 62 thereof. The depressions 61 are positioned directly beneath the flange portions 55‴ of the terminals 55 so that, when the terminal post screws 56 are turned to clamp the stripped ends of the cord 16, the plastic spring holding element 60 is prevented from any twisting movement. The top portion 62 is also provided with a pair of diametrically opposed square notches 63 which allow for the mounting of the spring holding element. The notches 63 clear the terminals 55 upon initial assembly and then are rotated 90 degrees to align the depressions 61 with the flange portions 5‴ of the terminals. Extending downwardly from the center of the top portion 61 is a stem post 64 which telescopingly receives thereabout the spring 70, one end of the spring 70 abutting the bottom of the top surface 62. The other end of the stem post 64 is received in the opening 54 of the cylindrically-shaped mounting piece thereby firmly mounting the spring holding element within the cylindrically-shaped-mounting piece 50. The end of spring 70 remote from the bottom of the top surface 62 is in abutment with the top surface of the plastic disc 80 which thereby urges the metal prongs of the light bulb into holding engagement in the slots 56. The plastic disc 80 is best seen in FIG. 4 and is comprised of a central opening 81 which allows passage of the stem post 64 of the spring holding element 60, and a pair of diametrically opposed notches 82 which allow for clearing of the metal terminal posts 55, upon assembly and for orientation of the plastic disc in the mounting piece by the terminals 55.

Figure 6:
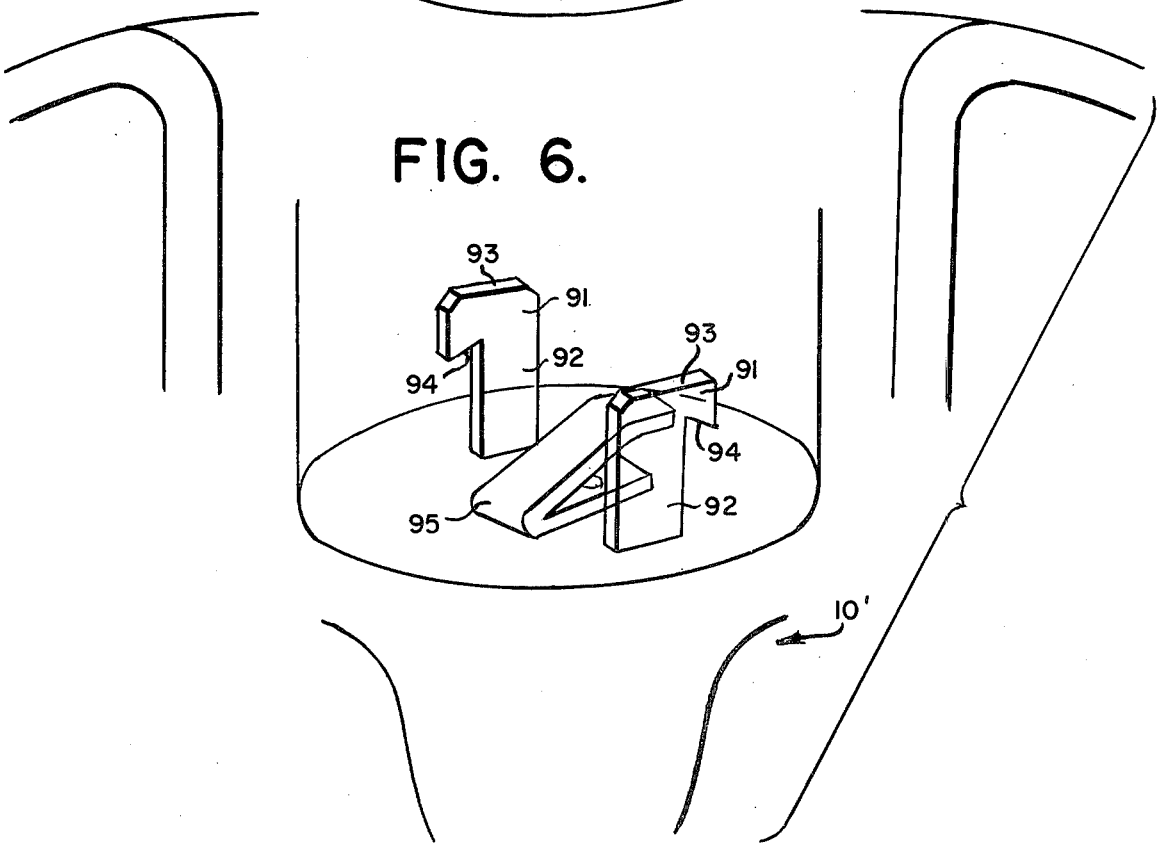
FIG. 6 is a perspective view showing the light bulb of the present invention with metal contact prongs and spring clip for urging the prongs downwardly in place in the cylindrically-shaped mounting piece.

FIG. 6 shows a portion of the spherical light bulb of the first embodiment. The bulb 10′ has a pair of metal prongs 91 extending upwardly from a plate mounted within the bulb. The metal prongs have an upstanding portion 92 terminated by an angled portion 93 which forms a saw-toothed shaped surface 94 corresponding to the saw-toothed shaped surface formed by portions 56′ and 56″ of the slots 56. Mounted between the metal prongs 91 is a spring clip 95 which bears against the bottom surface of the mounting piece 50 to further aid in the holding of the prongs 91 in the slots 56 and to effect release of the bulb. The metal prongs 91 are inserted into the mounting piece 50 by sliding the prongs through the portion 56′ and rotating the bulb 90 degrees so that the angled portions 93 rest in the portions 56″ of the slots 56. When the prongs are positioned in the slots 56, the top surface of the angled portion 93 is flush with the top surface of the bottom portion of the mounting piece and is held in place by the biasing action of both the spring 70 and the spring clip 95.

It can, therefore, be seen that the socket mounts the spherical light bulb thereabout when it is hanged from a ceiling or the like, by the cord 16, and supplies currents to the filament of the bulb.

The second embodiment of the invention is shown in FIGS. 7–11. The difference between this embodiment and the first embodiment lies in the manner of securing the spherical light bulb to the socket. Instead of the metal prongs and curved slots of the first embodiment, which are held in place by the spring holding element, the spring 70, and the plastic disc 80, the second embodiment secures the bulb to the socket by mating threads on the outer surface of the mounting piece and on the inner surface of a sleeve of the spherical bulb. The second embodiment comprises the top removable cover plate 20, the metal hinged clamp 30, and the separating disc 40 described in the first embodiment and therefore needs no further explanation.

Figure 7:
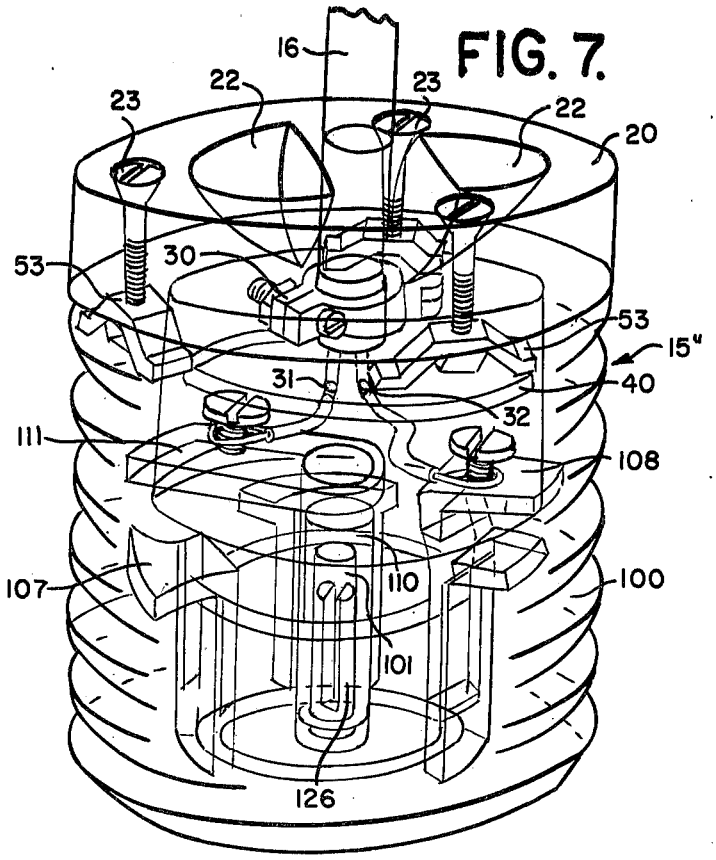
FIG. 7 is a perspective view showing the second embodiment of the light bulb and socket arrangement of the present invention.
Figure 11:
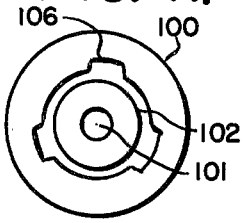
FIG. 11 is an end view of the cylindrically-shaped mounting piece of FIG. 8.
Figure 10:
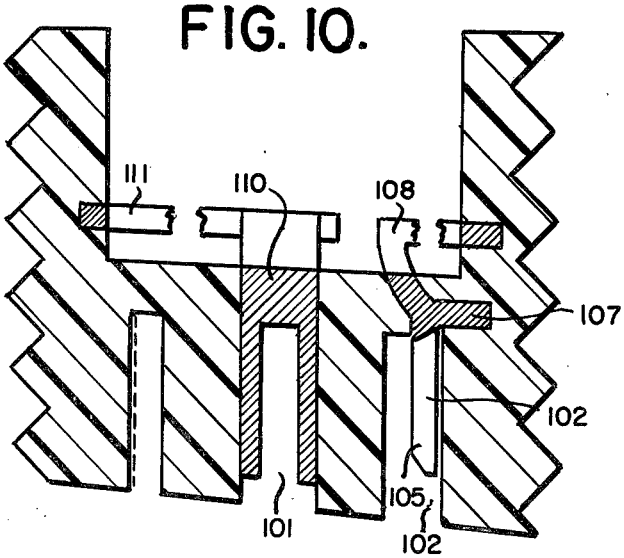
FIG. 10 is a cross-sectional view of the cylindrically-shaped mounting piece of FIG. 8.
Figure 8:
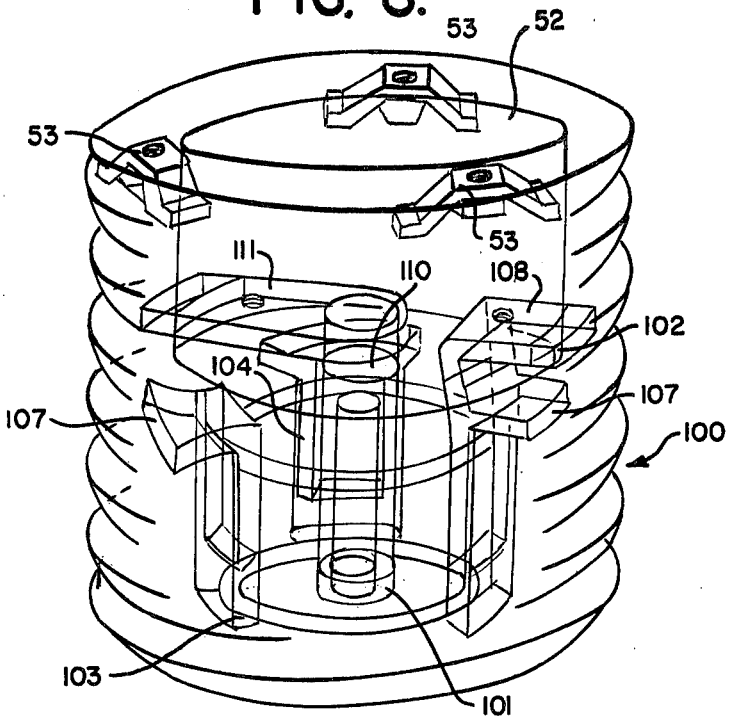
FIG. 8 is a perspective view showing the modification of the cylindrically-shaped mounting piece used in the embodiment of FIG. 7.

The mounting piece 100 of the second embodiment is best seen in FIGS. 7, 8 and 10. It contains the nuts 53 and the enlarged opening 52, as in the first embodiment, a central lower opening 101 of smaller diameter than the opening 52, extending from the top of the bottom portion of the mounting piece to the bottom thereof, and an annular groove 102 circumscribing the lower opening 101 as can be seen in FIG. 10. There are three metal strips 102, 103, and 104 cast into the plastic. Each strip has an elongated portion 105 which is situated in a slot 106 (see FIG. 11) and which is spaced circumferentially about the annular groove. The slots 106 and the metal strips therein are spaced equiangularly about the circumference of the annular groove. Each of the metal strips have a spring action and extend partially into the annular groove 102 in order to hold firmly the contact ring of the spherical bulb. Each metal strip has a flange portion 107 embedded in the in the plastic of the mounting piece. The metal strip 102 is further provided with a flange portion 108 partially embedded in the plastic and which is slightly greater in width than the portion 107. The flange portion 108 serves the same function as the flange portion 55''' of FIG. 5 and has a threaded opening therein for the reception of a terminal post screw 56. The opening 101 has mounted therein a metal receptor 110 which extends upwardly therefrom to a level parallel with the flange portion 108. Flange portion 111 of the receptor 110 has one end cast into the plastic of the mounting piece and is provided with a threaded opening for receiving the other terminal post screw 56. Thus, the flange portions 108 and 111 provide the terminal contacts for the stripped ends of the cord 16.

Figure 9:
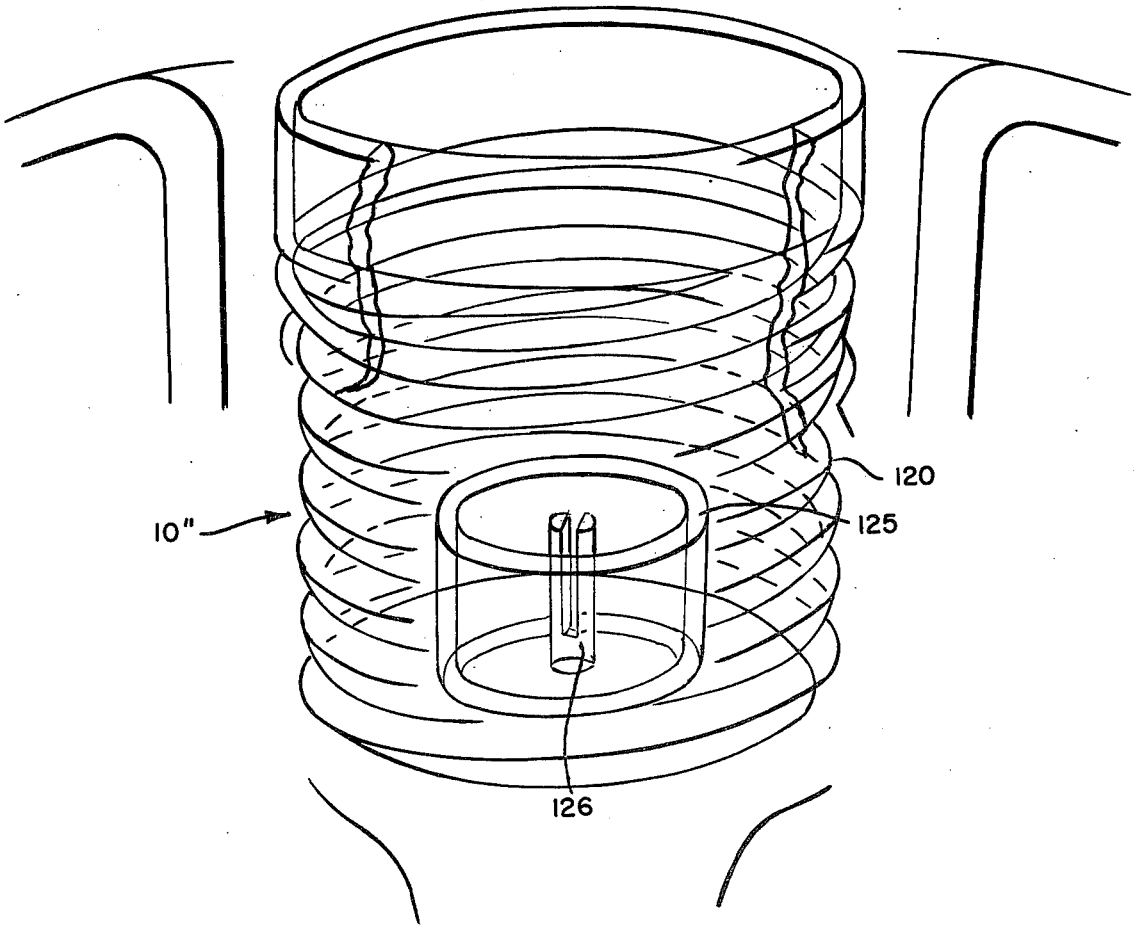
FIG. 9 is a perspective view showing the light bulb used in the embodiment of FIG. 7.

The spherical light bulb 10'', in this embodiment, is provided with a sleeve 120 covered with a threaded metal sheath which screws into the threads on the outer surface of the mounting piece. The sleeve 120 is provided in the interior thereof with a metal ring 125 extending upwardly from the bottom surface of the sleeve, as can be seen in FIG. 9. The ring 125 has a split prong 126 therein which prong is received in the lower central opening 101. Therefore, the terminals 108 and 111 supply current to the filament of the bulb via the ring 125 and the split prong 126, respectively.

The socket and light bulb arrangement are hung from a ceiling or the like via the cord 16. If greater strength is needed for the cord 16 in order to support a bulb of greater weight, the cord may be surrounded with woven steel, such as used in coaxial cables. In such a case, the enforced cord would be supported in a standard electrical ceiling box by a clamp provided therein. A covering disc may also be provided which covers the ceiling box and allows for the passage of the reinforced cord to pass through.

The light bulb may be connected to the socket in the first embodiment by merely gripping the top cover plate with two fingers in the depressions 22 and sliding the metal prongs 91 through the slot portion 56' and rotating the bulb 10 degrees so as to bring the portions 93 in alignment with the portions 56'' of the slots 56. In the second embodiment, after gripping the depressions 22, all that is required is that the bulb be rotated so that the mating threaded portions on the mounting piece and the metal sheath of the bulb are held together.

The bulb of the invention need not be spherical in shape, but may also be cylindrical, pear-shaped, etc. It may also be polyhedral in shape so that the distinct shadows may be formed by the transitional areas between segments of the polyhedron. The bulb of the invention may also be frosted. Further, if desired, a fixture may be provided about the bulb, if desired.

While specific embodiments of the invention have been shown and described, it is to be understood that numerous changes and modifications may be made without departing from the scope and spirit of the invention.

What is claimed:

1. A light socket and bulb combination comprising a top cover plate having a central aperture for receipt of an electrical cord, a first mounting piece comprising means for removably securing said top cover plate thereon, an enlarged central opening formed from the top surface of said first mounting piece downwardly to near the bottom surface thereof, a first metal terminal and a second metal terminal diametrically opposite said first metal terminal, said first mounting piece being made of a plastic and each of said first and second metal terminals having at least a portion thereof cast into the plastic and a portion open to said central opening for attachment to said electrical cord, a second mounting piece integral with said light bulb and having filament contacts comprising prongs extending outwardly of said second mounting piece, means extending through the bottom surface of said first mounting piece for receiving the contacts of said light bulb, said means for receiving the contacts of a light bulb comprise a pair of diametrically opposed circumferential slots, each of said pair of slots comprising a first vertical portion extending from the bottom surface of said first mounting piece upwardly toward said enlarged central opening, and a second triangular portion having a first end in communication with said first vertical portion and a second end spaced circumferentially about said first mounting piece and adjacent to one of said first and second metal terminals so that when said prong is inserted into one of said slots it contacts one of said first and second metal terminals, said first and second mounting pieces are removably secured together and the respective contacts of said light bulb are held in engagement with said first first and second metal terminals, whereby when the electrical cord is connected to a power source current is supplied to the filament of the light bulb via said first and second metal terminals and the contacts of the light bulb.

2. The light socket according to claim 1, wherein said means for holding the contacts of a light bulb in contact with said terminal comprises a spring having a first end and a second end spaced vertically from said first end, a spring holding element mounted below a portion of said first and second metal terminals engaging said first end of said spring and having an elongated stem post extending downwardly for the mounting of said spring thereabout, and a plastic disc engaging with said second end of said spring for urging the contacts of said light bulb into said slots.

3. The light socket according to claim 2, wherein said first mounting piece further comprises an opening formed in the bottom portion thereof at the lower end of said enlarged central opening for the reception therein of the end of said elongated stem post.

4. The light socket according to claim 3, wherein said spring holding element further comprises a pair of diametrically opposed depressions, and each of said first and second metal terminals comprises a flange portion extending toward each other and having a threaded hole therein and a pair of terminal post screws for engagement in said threaded holes for holding the stripped ends of an electrical cord, said terminal post screws engaging and holdng said spring holding element in place by contacting said spring holding element at said depressions.

5. The light socket according to claim 1, wherein each of said contact prongs comprising a first vertical portion and a second angled portion extending perpendicularly from the top of said first vertical portion, said first and second portions of each prong forming a surface similar to the surface defined between said first and second slot portions of each of said slots so as to snugly fit in said portions and thereby be held in place by said spring holding element, and a spring clip for urging said prongs into engagement with said slots and affecting removal of said prongs from said slots upon a 90 degree rotation of said prongs or remove said angled portions from said triangular portions of said slots.

6. The light socket according to claim 1, further comprising a separating plastic disc mounted below said top cover plate, said separating plastic disc having a pair of holes formed therein for the passage therethrough of the stripped ends of an electrical cord, and a clamp positioned between said separating plastic disc and said top cover plate for clamping said electrical cord in said top cover plate.

7. The light socket according to claim 6, in combination with an electrical cord, said electrical cord comprising a cover of woven steel, and a pair of stripped ends secured in place at said first and second metal terminals, said electrical cord passing through said central aperture of said top cover plate.

8. A light socket and bulb combination comprising a top cover plate having a central aperture for receipt of an electrical cord, a first mounting piece comprising means for removably securing said top cover plate thereon, an enlarged central opening formed from the top surface of said first mounting piece downwardly to near the bottom surface thereof, said first mounting piece being formed with a central aperture formed in the bottom surface thereof and extending upwardly toward said enlarged central opening, and an annular groove in said bottom surface thereof surrounding said central aperture, a first metal terminal and a second metal terminal diametrically opposite said first metal terminal, said first mounting piece being made of a plastic and each of said first and second metal terminals having at least a portion thereof cast into the plastic and a portion open to said aperture and said annular groove for attachment to said electrical cord, a second mounting piece integral with said light bulb and having filament contacts comprising a prong extending outwardly of said second mounting piece for insertion into said central aperture and a ring shaped metal contact for insertion into said annular groove, and means for removably securing said first and second mounting pieces together and holding the respective contacts of said light bulb in engagement with said first and second metal terminals, said contact holding means comprising a plurality of metal strips spaced equangularly about said annular groove and extending partially into said annular groove, one of said metal strips constituting said first metal terminal whereby when the electrical cord is connected to a power source current is supplied to the filament of the light bulb via said first and second metal terminals and the contacts of the light bulb.

9. The light socket according to claim 8, wherein said second metal terminal comprises a receptor having an opening for receiving said prong of a light bulb mounted in said central aperture and a flange portion extending perpendicularly from the top of said shaft away from said first metal terminal, said flange portion having a threaded hole formed therein and a terminal post screw for securing a stripped end of an electrical cord in said threaded hole.

10. The light socket according to claim 9, wherein said first metal terminal comprises an elongated portion extending upwardly from said bottom surface of said mounting piece and a flanged portion at right angles to said elongated portion and having threaded hole formed therein and a terminal post screw in said threaded hole for securing the other stripped end of an electrical cord.

11. The light socket according to claim 10, wherein said first mounting piece further comprises a threaded outer surface for mating engagement and said second mounting piece comprises a threaded surface to join said mounting pieces together.

12. The light socket according to claim 11, wherein, said second mounting piece comprises a threaded sleeve, a metal ring mounted within said sleeve for engagement in said annular groove, and a split prong positioned in said metal ring for engagement in said central aperture.

* * * * *